United States Patent [19]

Wilmes et al.

[11] 4,234,239

[45] Nov. 18, 1980

[54] EARTHING TERMINAL

[75] Inventors: Manfred Wilmes; Rudiger Obst; Wolfgang Kretzschmar, all of Detmold, Fed. Rep. of Germany

[73] Assignee: C. A. Weidmuller KG, Detmold, Fed. Rep. of Germany

[21] Appl. No.: 962,491

[22] Filed: Nov. 20, 1978

[30] Foreign Application Priority Data

Apr. 17, 1978 [DE] Fed. Rep. of Germany ... 7811403[U]

[51] Int. Cl.[3] ..... H01R 9/26

[52] U.S. Cl. ..... 339/198 GA; 339/272 UC

[58] Field of Search ..... 339/198 R, 14 R, 14 RP, 339/14 T, 14 P, 14 L, 198 GA, 198 N, 272 UC; 174/51

[56] References Cited

U.S. PATENT DOCUMENTS

| | | | |
|---|---|---|---|
| 3,201,747 | 8/1965 | Blanchet | 339/14 L X |
| 3,510,830 | 5/1970 | Wieland | 339/198 GA |
| 3,910,663 | 10/1975 | Winger | 339/14 R |

FOREIGN PATENT DOCUMENTS

| | | | |
|---|---|---|---|
| 2615134 | 7/1977 | Fed. Rep. of Germany | 339/198 GA |
| 2619506 | 11/1977 | Fed. Rep. of Germany | 339/198 GA |
| 2370370 | 7/1978 | France | 339/198 GA |
| 1410578 | 10/1975 | United Kingdom | 339/198 GA |

*Primary Examiner*—John McQuade
*Assistant Examiner*—John S. Brown
*Attorney, Agent, or Firm*—Pollock, Vande Sande & Priddy

[57] ABSTRACT

An earthing terminal for mounting on a support rail having a channel section with outwardly turned flanges comprises a yoke of bent sheet metal with a pair of hooks to fit under the flanges, and a metal clamping member with terminals, disposed between respective side parts of the yoke. The yoke has on each side part a lug, the ends of which are bent over to form flanges in which is threaded a clamping screw which contacts the metal member. By means of the clamping screw, the flanges of the support rail can be clamped between the hooks of the yoke, and adjacent parts of the metal member.

5 Claims, 2 Drawing Figures

EARTHING TERMINAL

This invention relates to earthing terminals, for mounting on support rails of the kind having a channel section with oppositely directed outwardly turned flanges.

Numerous such terminals have been proposed, but the known terminals are unreliable, inconvenient or complicated. For example, British Pat. No. 1,410,578 describes an earthing terminal which is reliable and provides automatic centering on the rail, and is convenient in that it can be fitted to the rail in a transverse direction instead of having to be slid along the rail from an end, but this terminal is very complicated in construction and is therefore costly.

The object of the present invention is to provide an earthing terminal which is reliable, simple in construction, and convenient in use.

According to the present invention, there is provided an earthing terminal adapted to be mounted on a supporting rail having a channel section with oppositely directed outwardly turned flanges, which terminal comprises a metal member for connection to a conductor; a yoke having a pair of hook portions for engagement under respective flanges of the support rail, each hook portion facing a respective portion of the metal member, the yoke further comprising two wall portions between which the metal member is disposed, and respective lugs upstanding from said wall portions and having their free ends bent towards one another with one overlying the other and spaced from the metal member, said free ends having aligned screw-threaded bores therein; and a clamping screw threaded in said bores and extending towards the metal member, whereby on tightening of the screw the metal member and yoke will be relatively moved for clamping the support rail flanges between the hook portions and the said facing portions of the metal member.

Because of the reaction which arises when the clamping screw is tightened, the free ends of the upstanding lugs are stressed and their bores jam against the clamping screw, so that the latter is automatically secured, and there is no need of any additional locking means such as a locking washer. The clamping screw simply rests against the metal member at the screw tip, and the metal member can be a simple solid body without any screw holes.

The yoke can be a simple integral body of bent sheet metal.

The hook portions may have centering means.

In order that the invention may be more clearly understood, reference will now be made to the accompanying drawings, wherein an embodiment of the invention is shown for purposes of illustration, and wherein.

Figure 1:
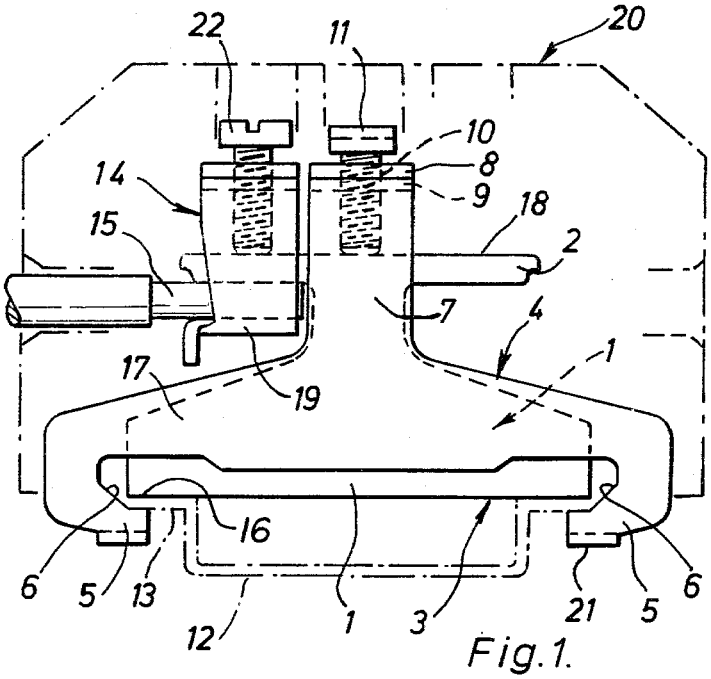
FIG. 1 is a side view of an earthing terminal embodying the invention.
Figure 2:
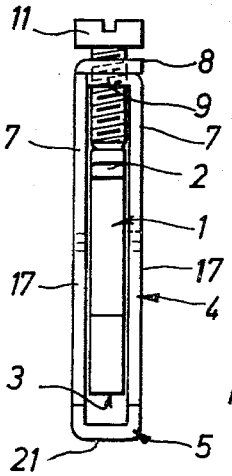
FIG. 2 is an end view of the clamping members of the terminal.

FIG. 1 shows an earthing terminal clamped on a metal support rail 12 of symmetrical channel section with oppositely directed outwardly turned flanges 13. Such rails are well known and have standardized dimensions. The flanges are clamped between hook portions 5 of a metal yoke 4, and opposed portions 16 of the lower surface 3 of a metal clamping member 1. These and other components of the earthing terminal are disposed in an insulating plastic housing 20 of generally slab-like shape such that a multiplicity of terminals of various kinds can be mounted side by side on the support rail.

The metal member 1 has roughly the shape of an H turned on its side, with one limb forming a clamping abutment and resting against the flanges 13, and the other limb forming a current-carrying bar, or rather a pair of current-carrying fingers 2. Each finger carries a screw-clamping terminal 14 comprising a metal sleeve 19 and a clamping screw 22, for clamping a conductor 15.

The yoke 4 surrounds the metal member 1 and has a pair of spaced wall portions 17 between which the metal member lies, and which are interconnected by webs 21 at each of the spaced opposite hook portions 5.

The internal surfaces of the yoke provide guidance for relative displacement of the yoke and the metal member.

The yoke is of generally inverted T shaped form, with the hook portions at the ends of the cross-piece, and the stem formed by upstanding lugs 7 which project above the top of the metal member 1.

The free upper ends of these lugs 7 are bent inwards towards one another, to form respectively a flange 9, and a flange 8 which overlies the latter. The flanges are spaced above and generally parallel to the top of the metal member 1 and each has a screw-threaded bore 10, the bores being in line with one another and receiving a clamping screw 11, the tip of which engages the upper surface 18 of the metal member 1.

Thus, by tightening the clamping screw, the hook portions 5 of the yoke can be raised towards the portions 16 of the metal member 1, thereby clamping the flanges 13 of the support rail as shown in FIG. 1. The inner sides of the hook portions have bevels 6, which cooperate with the flanges to center the earthing terminal on the support rail.

As already mentioned, when the screw is tightened, the reaction to the clamping force stresses and slightly deforms the flanges 8, 9, so that the bores 10 are pressed against the screw threads with a jambing or wedging action and the screw is effectively locked in position so that the terminal cannot accidentally become loose. It will be seen that the construction enables a short clamping screw to be used, that the metal member is of a simple construction and in particular requires no provision for screw holes, so that it can be a simple casting, and that the yoke can be made by a simple stamping and bending operation.

The hook portions 5 engage only the edge regions of the flanges 13, and the maximum spacing between the concave internal surfaces of the hook portions is appreciably greater than the overall width of the support rails. Consequently, the earthing terminal can be disengaged from the support rail by slackening the clamping screw, moving the terminal sideways relative to the rail, for example to the right in FIG. 1, so that one hook portion is moved clear of the associated flange, then lifting this hook portion from the rail and then disengaging the opposite hook portion from the other flange. The earthing terminal can be fitted to the rail by the opposite sequence of operations. Consequently the terminal can be fitted to and removed from the rail by movement perpendicular to the rail, and therefore without disturbing any adjacent terminals mounted on the same rail.

It will be readily seen that the earthing terminal described is very simple both in construction and in its manner of use.

We claim:

1. An earthing terminal adapted to be mounted on a supporting rail having a channel section with oppositely directed outwardly turned flanges, comprising (a) a metal member for connection to a conductor and adapted to rest on the upper surfaces of said flanges;

(b) a unitary rigid yoke of sheet metal, shaped to form (i) a pair of hook portions for engagement with the undersides of respective ones of said flanges of said support rail, each hook portion facing a respective surface portion of said metal member;

(ii) two wall portions between which said metal member is disposed; and (iii) respective lugs upstanding from said wall portions and having their free ends bent towards one another with one overlying the other and overlying and spaced from said metal member, said free ends having aligned screw threaded bores therein; and (c) a clamping screw threaded in said bores and extending towards said metal member, the tip of said clamping screw abutting the upper surface of said member;

(d) whereby, on tightening of said screw, said screw will advance toward said metal member, whereby said metal member and said yoke will be relatively moved for clamping said support rail flanges between said hook portions and said facing surface portions of said metal member.

2. A terminal as claimed in claim 1, wherein said metal member has at least one finger for connections to a conductor.

3. A terminal as claimed in claim 2, including on said at least one finger a clamping sleeve with a clamping screw for clamping a conductor to said finger.

4. A terminal as claimed in any one of claims 1, 2 or 3, including centering bevels on said hook portions.

5. An earthing terminal adapted to be mounted on a supporting rail having a channel section with oppositely directed outwardly turned flanges, comprising (a) a metal member attachable to said rail to form a counter-abutment and comprising a current-carrying bar; and (b) a unitary rigid clamping yoke of bent sheet metal movable relative to said metal member and having hook-shaped lugs on both sides engaging under the flanges of said rail, said yoke further comprising two lugs which project above said metal member and the upper ends of which are bent to form mutually overlapping flanges each of which is provided with a screw-threaded bore through which a screw is screwed against the upper surface of said metal member.

* * * * *